United States Patent [19]

Takano

[11] Patent Number: 5,043,540

[45] Date of Patent: Aug. 27, 1991

[54] SLIDE SWITCH

[75] Inventor: T. Takano, Tokyo, Japan

[73] Assignee: Kabushiki Kaisha T and T, Tokyo, Japan

[21] Appl. No.: 533,776

[22] Filed: Jun. 6, 1990

[30] Foreign Application Priority Data

Jun. 14, 1989 [JP] Japan ..... 1-69291[U]
Jun. 14, 1989 [JP] Japan ..... 1-69292[U]

[51] Int. Cl.[5] ..... H01H 15/02
[52] U.S. Cl. ..... 200/16 C; 200/16 D
[58] Field of Search ..... 200/16 R, 16 C, 16 D

[56] References Cited

U.S. PATENT DOCUMENTS 3,029,320 4/1962 Laete ..... 200/16 C
4,311,885 1/1982 Arthur ..... 200/16 C
4,710,600 12/1987 Sasaki et al. ..... 200/16 C X
4,764,745 8/1988 Aoi et al. ..... 200/16 C X

FOREIGN PATENT DOCUMENTS 50-23681 3/1975 Japan .

*Primary Examiner*—J. R. Scott

*Attorney, Agent, or Firm*—Nixon & Vanderhye

[57] ABSTRACT

A slide switch includes a slide body having a movable electrical contact. An insulating housing for the sliding body is formed in a substantially inverted U-shape and is provided with a slot to allow a knob to project therethrough and thus permit the sliding body to be manually manipulated. The housing also includes a number of projecting pins which are received within respective holes formed in a bottom insulating plate to provide connection between the housing and the plate. At least one pair of elongate conductive contact plates extend transversely relative to movements of the slide body (and hence relative to movements of the movable contact). Each of the conductive contact plates defines an aperture at one end thereof through which a respective one of the projecting pins of the housing passes before entering a respective one of the holes defined in the insulating plate. In this manner, the pair of contact plates are positioned within the housing and are, moreover, captured between the housing and the plate. Movement of the slide body, and hence the movable electrical contact, relative to the pair captured contact plates thereby makes and breaks an electrical circuit.

6 Claims, 7 Drawing Sheets

SLIDE SWITCH

FIELD OF THE INVENTION

The present invention generally relates to slide switches, and more particularly, to improvements in mounting a movable contact leaf of a slide switch.

BACKGROUND OF THE INVENTION

Slide switches in and of themselves, are known. For example, Japanese laid-open utility model No. 50-23681, discloses a switch having a movable contact leaf performing its switching function by rightward/leftward pivotal movements. Lug leaves are located on the center of each side of the movable contact leaf and are semi-circular or V-shaped. A movable leaf receptor on which the movable contact leaf is placed is formed of a thin elastomeric plate and includes right/left riser surfaces which are bent inwardly at an acute angle. A bent curved surface is formed on a broken-away part of the right/left riser surfaces of the receptor, and an inclined surface is formed on the upper part of the riser surfaces so that the receptor can hold the movable contact leaf.

The prior art, as evidenced by the above-discussed Japanese laid-open utility model No. 50-236781, in which a conductive receptor with a U-shape section holds a movable contact leaf so that the leaf does slip from the receptor, relates to a slide switch whereby the movable contact leaf performs a "seesaw" motion with a fixed contact leaf as a supporting point so as to make and break contact with the fixed contact leaf in response to reciprocal movements of an actuating knob. Therefore, such a slide switch arrangement forms a current path through many contact parts and caulked terminals. As a result, electric current flows from the lead wire extended sequentially from one pole of a power supply along a path established by the caulked terminal, the conductive receptor, the movable contact leaf, the fixed contact leaf, the other caulked terminal, the lead wire, a load, and then finally to the other pole of the power supply.

The current path established by such a switch has caused problems where the slide switch is used for a large current path even with low voltage. For example, Joule heat is generated due to contact resistance at the contact parts and the caulked part of the caulked terminals as described above. The use of many component parts and caulking as described above, moreover, results in a complex arrangement, leading to difficulties in handling, with decreased productivity and increased cost.

It is towards providing a solution to these problems that the present invention is directed.

SUMMARY OF THE INVENTION

The present invention is directed towards improving switch assemblies and eliminating caulked parts and lead wires in such a manner that the movable contact leaf extending over a plurality of fixed contact leaves is elastically clicked and mounted with its locking part into a concave part of a sliding body. As a result, the movable contact leaf is prevented from falling during assembly.

Another aspect of the present invention is to eliminate caulked parts and lead wires in such a manner that a plurality of narrow conductive plates designated as a so-called bus bar are provided in parallel on the fixed contact leaves so that a current is allowed to flow between the fixed contact leaves via the movable contact leaf that extends over them.

The above-mentioned objects of the present invention can be achieved by including an insulating housing having an interior recess such that the housing has a substantially reversed U-shape cross-section. A slot is open to the recess of the insulating housing. An insulated sliding body is provided with a knob that projects externally through the slot and is movably received within the recess of the insulating housing. A movable contact leaf with legs that establish a substantially U-shape cross-section includes a lock part that is inserted through companion holes in the sliding body and then engage luck holes whereby the sliding contact is mounted to the sliding body. An elastic spring provided between the top surface of the movable contact leaf and the sliding body so as to exert a downward force against the movable contact. An insulating plate is provided with grooves in which a plurality of fixed contact leaves are positioned. In this manner, the fixed contact leaves extend transverse to the sliding body.

Disconnection of the movable contact leaf from the sliding body may be prevented during assembly by coupling the locking part of the movable contact into the recess of the sliding body. That is, with the spring positioned between the companion holes located opposite to the sliding body, the legs of the movable contact leaf may be inserted therethrough until the respective lock holes of the sliding body are engaged by the lock part. In such a manner, the movable contact is not disconnected from the sliding body even by the elastic force of the spring.

A plurality of narrow conductive plates, (i.e. a so-called bus bar) are provided in parallel as fixed contact leaves so as to allow pairs of the same to be electrically coupled via controlled movements of the movable contact. That is, moving the movable contact leftward by manipulating the knob allows electric current to flow between a pair of fixed contact leaves through the movable contact. Further movement centerward allows electric current to flow between another pair of fixed contact leaves in a similar manner. And, further rightward movement of the knob causes one side of the movable contact leaf to bear against the surface of the insulating plate which, in turn, interrupts the electrical circuit allowing the switch to be turned "off".

Therefore, a slide switch according to the present invention eliminates caulked parts and lead wires and exhibits less contact resistance, heat generation, and voltage drop as compared to prior art switches.

BRIEF DESCRIPTION OF THE ACCOMPANYING DRAWINGS

All drawings indicate a preferred embodiment according to the present invention wherein.

DETAILED DESCRIPTION OF THE PREFERRED EXEMPLARY EMBODIMENTS

Preferred embodiments according to the present invention will be explained hereinafter with reference to the accompanying drawings.

Figure 1:
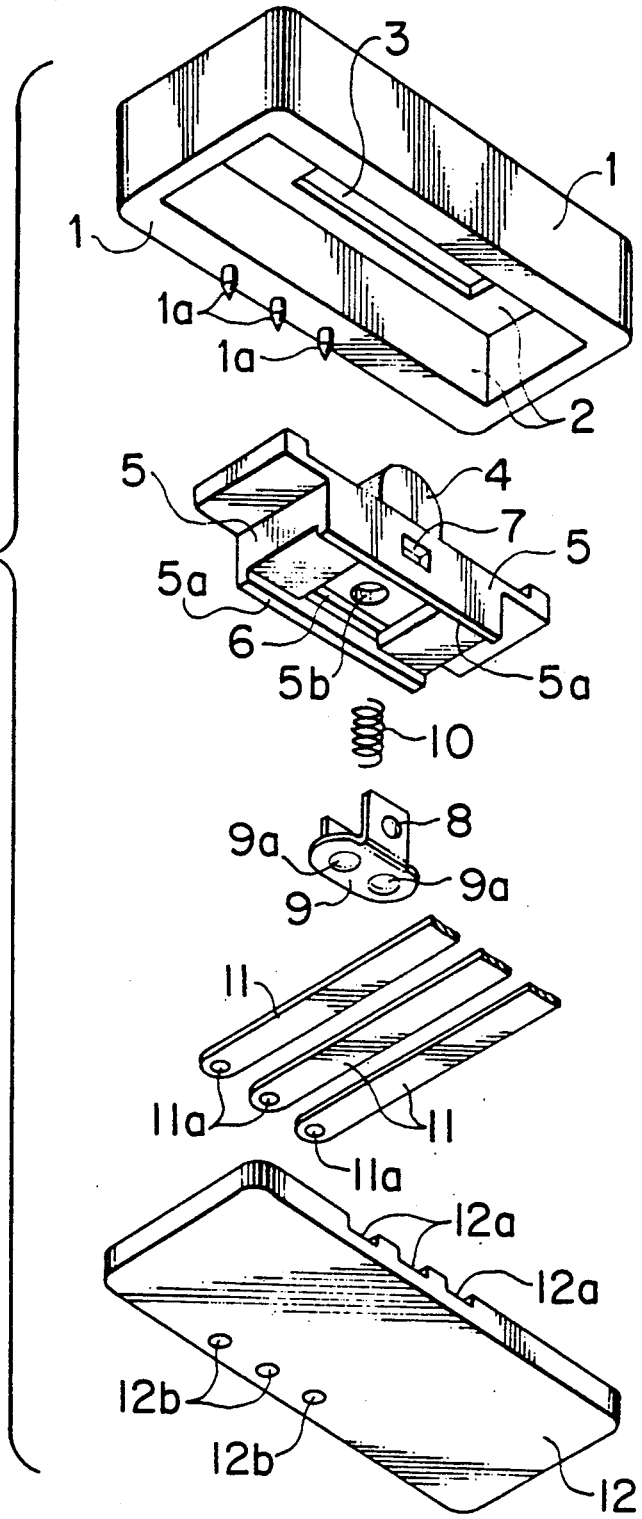
FIG. 1 is an exploded and perspective view of a slide switch viewed from below.
Figure 2:
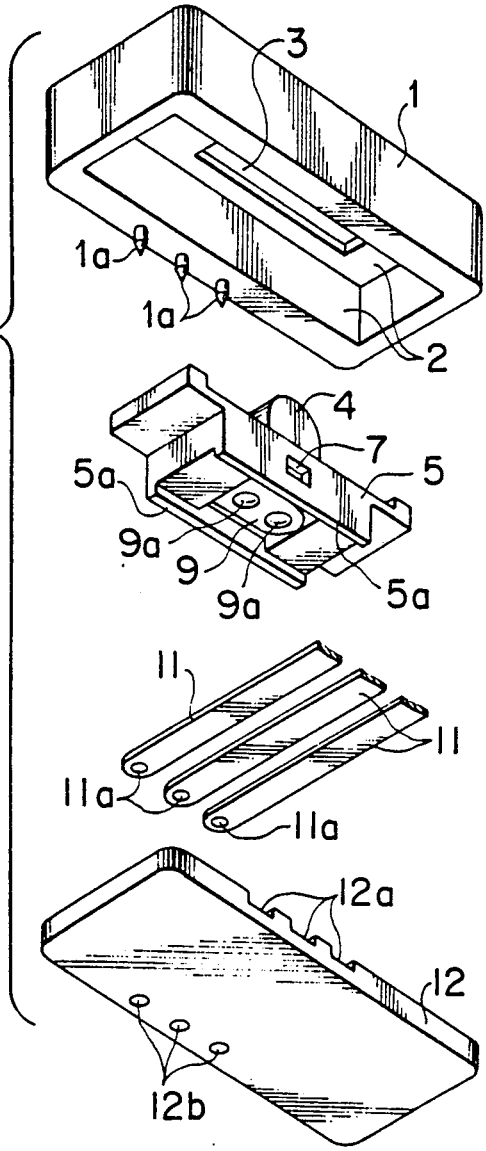
FIG. 2 is an exploded and perspective view of the same with a movable contact leaf mounted on a sliding body.
Figure 8:
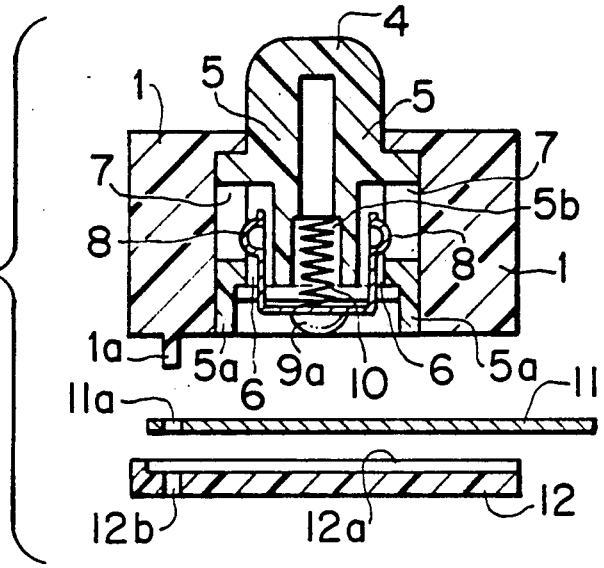
Figure 9:
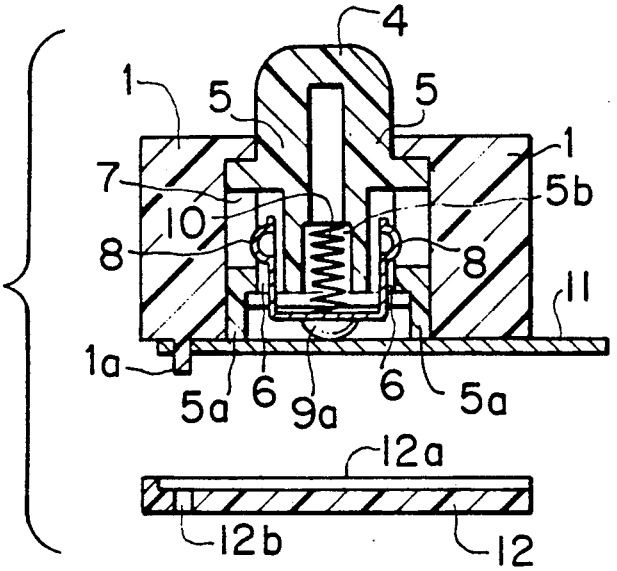
Figure 10:
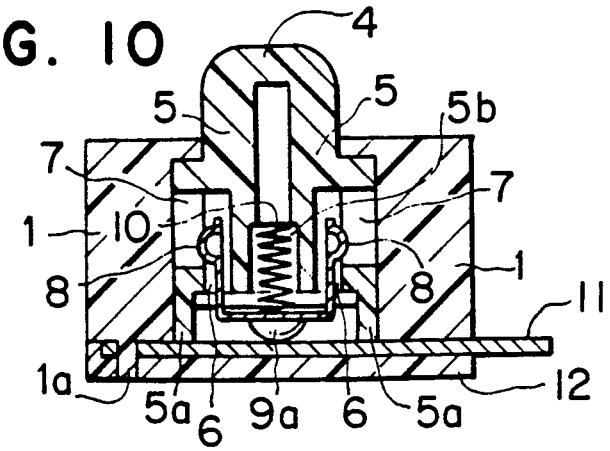
Figure 11:
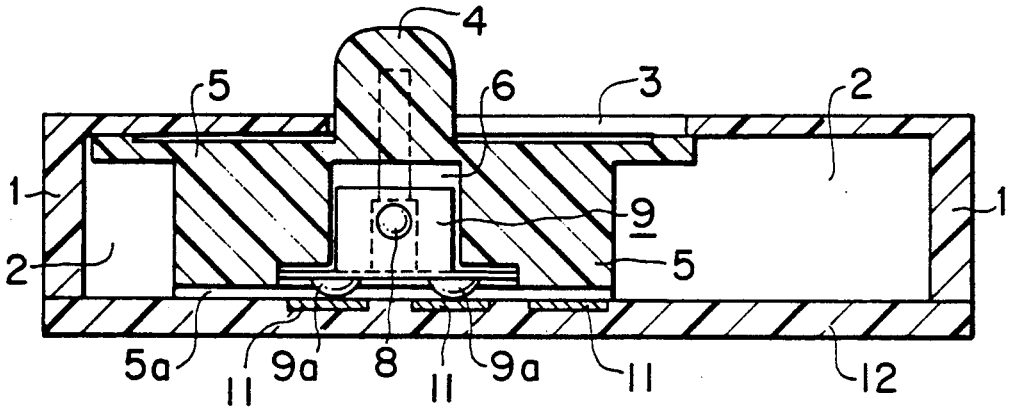
FIGS. 11 through 13 are longitudinal sectional views of a slide switch which respectively depict the movable contact thereof in several of its operable positions respectively.
Figure 12:
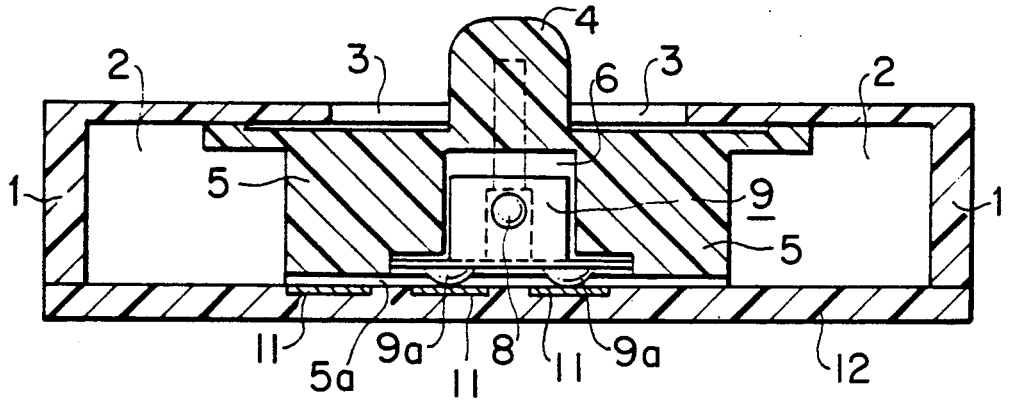
Figure 13:
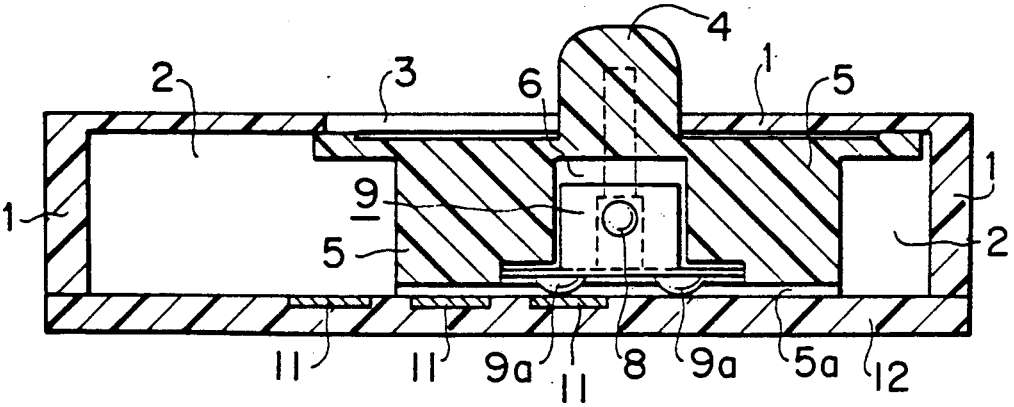

The basic construction of the switch according to the present invention, as shown in FIGS. 1 and 2, includes a slot 3 formed in the insulating housing. The slot 3 opens into an interior recess 2 of the insulating housing 1. Thus, the cross-section of the housing 1 is formed substantially in a reversed U-shape using a plastics material or the like (see FIG. 6). An insulated sliding body 5 (e.g. made of plastics material) is provided with a knob 4 which projects outwardly through the slot 3 as shown in FIGS. 8–10. The sliding body 5 is movably received within the interior recess 2 of the insulating housing 1 as shown in FIGS. 11 through 13.

Figure 6:
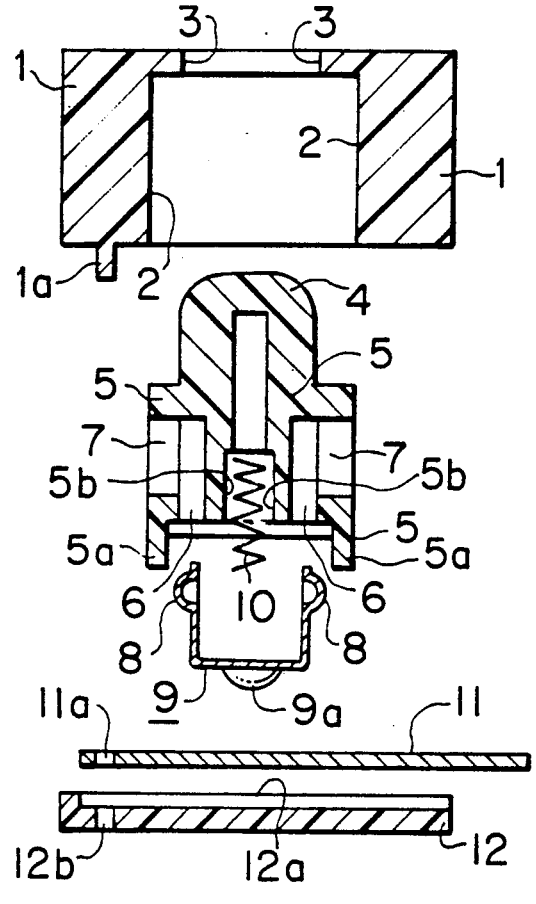
FIGS. 6 through 10 are sectional elevations of those slide switches shown in the above FIGS. 1 through 5 respectively.
Figure 7:
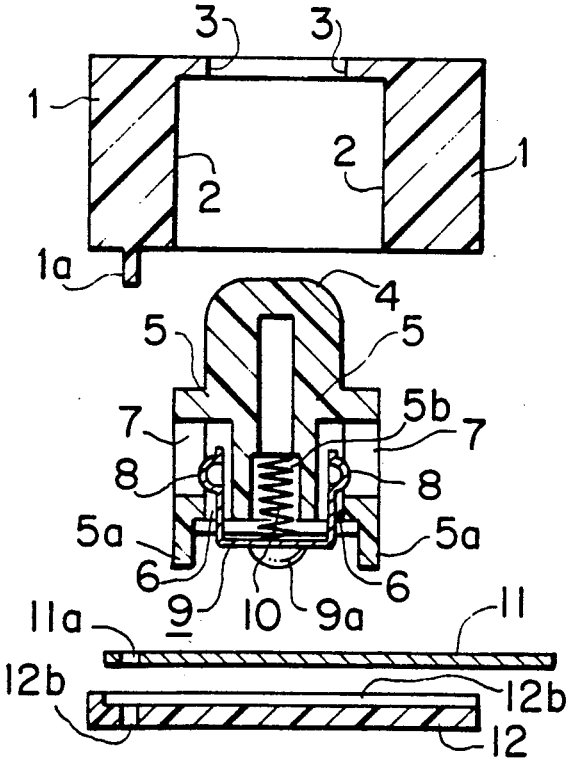
Figure 15:
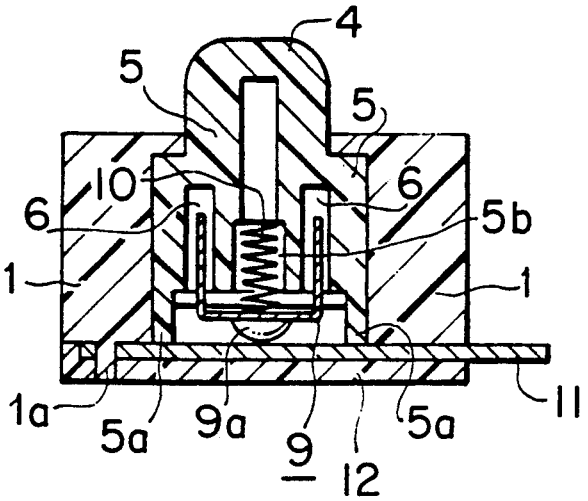

A movable contact leaf 9 having a substantially U-shaped section as shown in FIGS. 1 and 6 is also inserted into the sliding body 5 in the manner shown in FIGS. 7 and 15. As is seen, the less of the sliding body 5 are placed into companion holes 6 drilled on the lower part of the sliding body 5 as shown in FIG. 6.

The slide switch according to the present invention is further comprised of an elastic spring 10 which is positioned between the top surface of the movable contact leaf 9 and the sliding body 5 within the recess **5*b* as shown in FIG. 6. An insulating plate 12 is provided with grooves 12*a* which are sized and configured to accept respective fixed contacts 11 which extend transversely relative to the movable contact leaf 9. The sliding body has a pair of rails 5*a* on either side of the sliding contact and serve as bearing surfaces for movement of the sliding body 5 transversely across the fixed contacts 11**.

The housing 1, includes a number of protrusions **1*a* which extend through the small holes 11*a* of the contact leaves 11, and into a respective small hole 12*b* defined in the insulating plate 12. In such a manner, the protrusions 1*a* position the fixed contact leaves 11 between the insulating housing and plate 1 and 12**, respectively so they can be locked therebetween.

Assembly procedures for the slide switch according to the present invention will be explained below.

The elastic spring 10 is provided in the recess **5*b* located centrally between the companion holes 6 on opposite sides of the sliding body 5. The legs of the movable contact leaf 9 will thus be inserted into the companion holes 6 until the lock part 8 of the movable contact leaf 9 resisting with the lock hole 7 of the sliding body 5. Cooperation between the lock part 8 and hole 7 thus couples the movable contact leaf 9 onto the lower part of the sliding body 5. In this manner, the movable contact leaf 9 is prevented from unlocking under influence of the elastic force of the spring 10 as shown in FIGS. 2 and 7**.

The lock part 8 is positioned such that the movable contact leaf 9 may be depressed slightly upwardly through the companion holes 6 against the elastic force of the spring 10.

Figure 3:
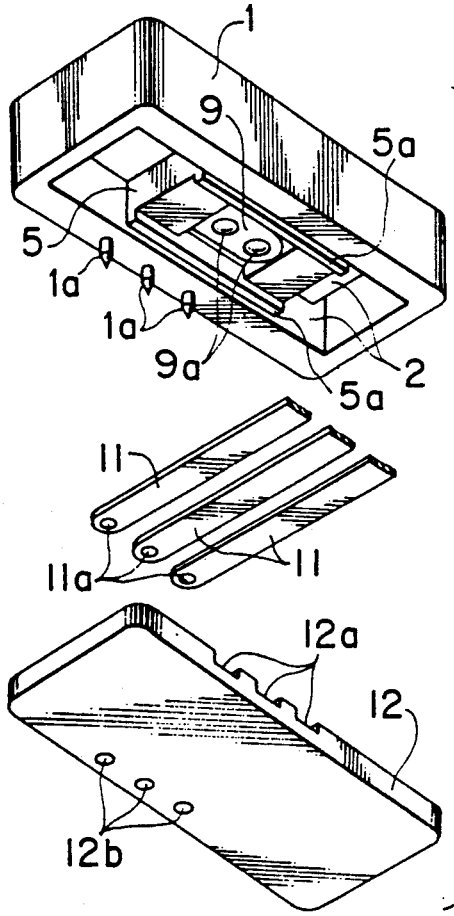
FIG. 3 is an exploded and perspective view of the same with a sliding body inserted into an insulating housing.

The sliding body 5 is then inserted into the recess 2 of the insulating housing 1 so that the knob 4 extends outwardly through slot 3 as shown in FIGS. 3 and 8.

Figure 4:
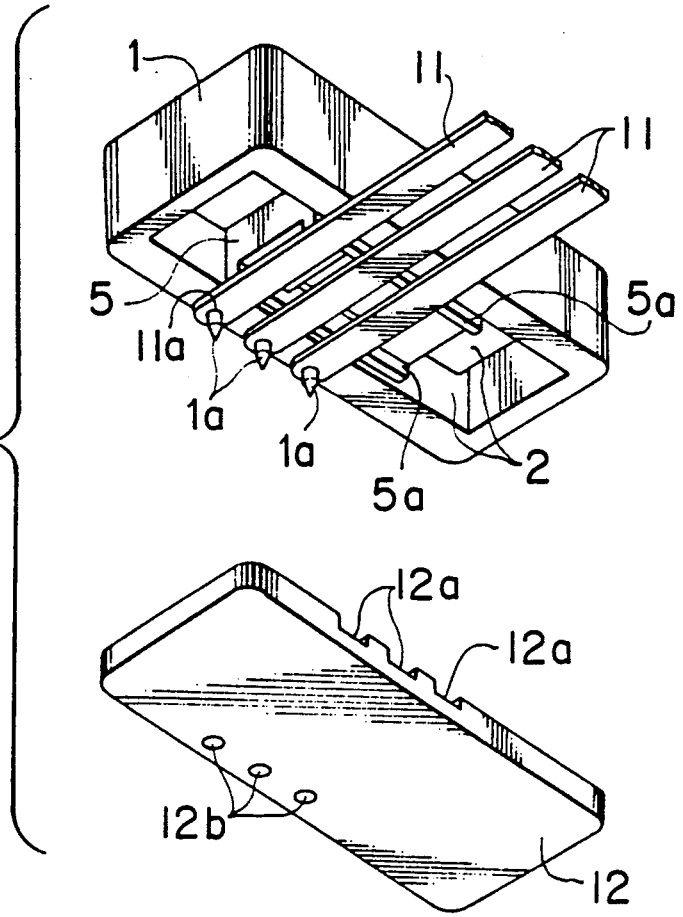
FIG. 4 is an exploded and perspective view of the same with fixed contact leaves mounted on an insulating housing.
Figure 5:
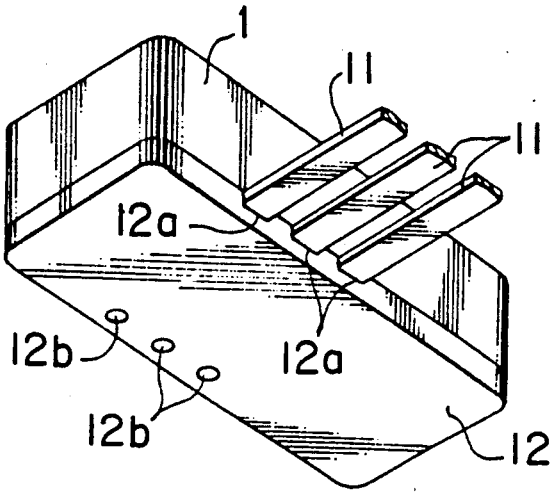
FIG. 5 is a perspective view of a finished product viewed from below.

The small holes **11*a* of the fixed contact leaves 11 are then placed onto a respective use of the protrusions 1*a* of the insulating housing 1 as shown in FIGS. 4 and 9. The insulating plate 12 is then placed onto the bottom of the insulating housing 1 such that the protrusions 1*a* extend into a respective use of the plate's small holes 12*b* and such that the fixed contact leaves 11 are positioned within a respective use at the grooves 12*a*. As will be appreciated, the positioning of the insulating plate 12 will slightly depress the movable contact 9 against the fence of springs 10. Thus, to maintain the insulating plate 12 in position, an elastic lock leaf or set screw (not shown) is used. The assembled switch is shown in FIGS. 5 and 10**.

The operation of the slide switch is as follows:

First, when the movable contact leaf 9 is moved leftward by manipulation of the knob 4 as shown in FIG. 11, electric current flows between the lefthand and center fixed contact leaves 11 through the movable contact leaf 9.

Moving the contact leaf 9 into a center position as shown in FIG. 12, electric current flows between the center and the righthand fixed contact leaves 11 in a similar manner. Further rightward movement of the sliding body 5 to the righthand position as shown in FIG. 13 causes one side of said movable contact leaf **9*a* to contact the surface of the insulating plate 12, which in turn causes the conductivity between the fixed contact leaves 11** to be interrupted. As a result, the switch is in an "off" position.

Figure 14:
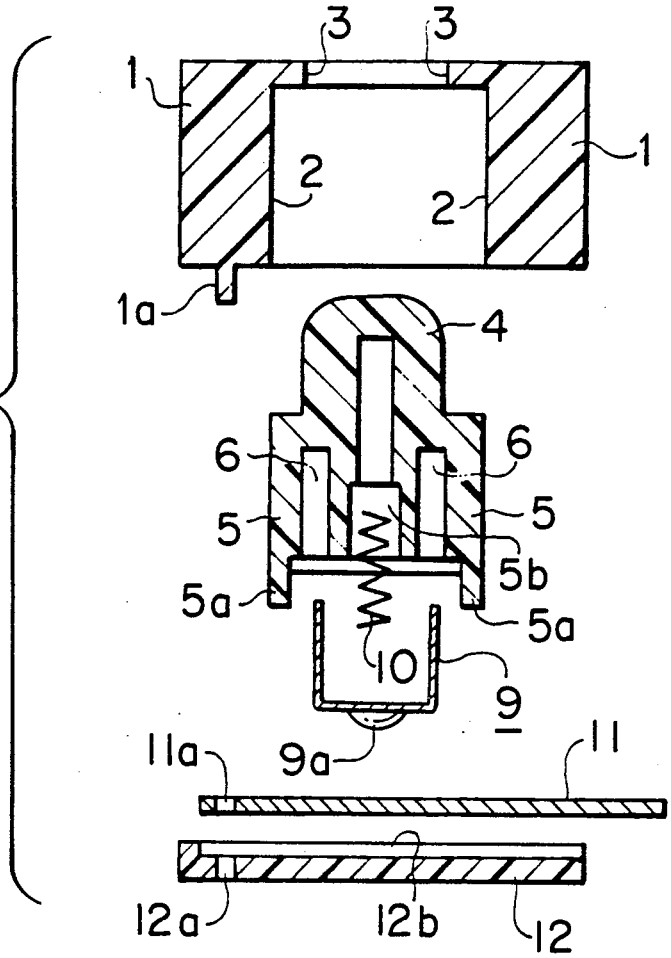
FIGS. 14 and 15 are sectional views indicating another embodiment according to the present invention.

The slide switch may be assembled as shown in FIG. 15 with the movable contact leaf 9 provided with no lock part as shown in FIG. 14.

As will now be appreciated, one advantage of the present invention is that with the elastic spring 10 provided between the companion holes 6 located on opposite sides of the sliding body 5, the legs of the movable contact leaf 9 can be inserted thereinto, and the lock part 8 of the movable contact leaf can then be lockingly clicked into the lock hole 7 of the sliding body. As a result, the movable contact leaf 9 can be lockably mounted on the lower part of the sliding body 5 so that the movable contact leaf 9 is not uncoupled therefrom even under influence of force of spring 10.

Furthermore, when the movable contact leaf 9 by manipulating the knob 4 is moved leftward, electric current is allowed to flow between one pair of fixed contact leaves 11. Movement of the knob 4 towards a center position allows electric current to flow between another pair of fixed contact leaves 11. And, moving the knob 4 further rightward causes one side of the movable contact leaf **9*a* to abut against the surface of the insulating plate 12** which, in turn, breaks the circuit allowing the switch to be turned "off".

Therefore, a plurality of narrow conductive plates (i.e. a so-called bus bar) may be provided in parallel in reference of fixed contact leaves. The slide switch thus allows electrical conductivity between pairs of the fixed contact leaves to be controlled through movements of the movable contact leaf so that caulked parts or lead wire can be eliminated. Accordingly, the present invention provides a slide switch with minimum contact resistance, less heat generation and less voltage drop at lower cost.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

I claim:

1. A slide switch comprising:

an electrically insulating housing defining a central recess and an elongate slot which opens into said recess;

said housing including a number of projecting pins;

a slide body received within said central recess of said housing so as to be slidably movable therewithin between at least first and second positions, wherein said slide body includes (i) a knob which protrudes outwardly from said housing through said defined slot so as to be moved manually from one end of the slot to another end and thereby slidably move the slide body between said at least first and second positions, and (ii) an electrical contact which is movable with said slide body between said at least first and second positions thereof;

an electrically insulating plate defining a number of holes sized and configured to accept a respective one of said projecting pins therewithin so as to connect said insulating plate to said housing in converging relationship to said defined central recess thereof; and at least one pair of elongate conductive contact plates each of which defines an aperture at one end thereof through which a respective one of said projecting pins of said housing passes before entering said respective one of said holes defined in said insulating plate, wherein said at least one pair of elongate conductive contact plates is captured between said electrically insulating housing and plate and extends transversely relative to said movements of said slide body between said first and second positions thereof, wherein said electrical contact that moves with said slide body makes contact with said at least one pair of contact plates when said slide body is in said first position thereof, and breaks contact with said at least one pair of contact plates when said slide body is in said second position thereof.

2. A slide switch as in claim 1, wherein said slide body includes an opposing pair of slide rails.

3. A slide switch as in claim 1, wherein said housing includes a pair of lock holes, and said electrical contact is generally U-shaped and includes a pair of lock parts that cooperate with said lock holes to prevent uncoupling of said electrical contact from said slide body.

4. A slide switch as in claim 3, wherein said slide body includes a spring acting upon said electrical contact.

5. A slide switch as in claim 4, wherein said slide body includes a spring recess in which said spring is positioned.

6. A slide switch as in claim 1, wherein said insulating plate defines a number of grooves extending respectively from said holes and wherein each of said grooves accepts a respective one of said contact plates therein.

* * * * *